US011786081B2

(12) United States Patent
Babuadze

(10) Patent No.: US 11,786,081 B2
(45) Date of Patent: Oct. 17, 2023

(54) APPARATUS FOR BEING MOUNTED ABOVE A SHOWER AREA

(71) Applicant: Nodar Babuadze, Epsom (GB)

(72) Inventor: Nodar Babuadze, Epsom (GB)

( * ) Notice: Subject to any disclaimer, the term of this patent is extended or adjusted under 35 U.S.C. 154(b) by 0 days.

(21) Appl. No.: 16/347,382

(22) PCT Filed: Nov. 3, 2017

(86) PCT No.: PCT/GB2017/053314
§ 371 (c)(1),
(2) Date: May 3, 2019

(87) PCT Pub. No.: WO2018/091864
PCT Pub. Date: May 24, 2018

(65) Prior Publication Data

US 2019/0307294 A1 Oct. 10, 2019

(30) Foreign Application Priority Data

Nov. 18, 2016 (GB) ..... 1619502
Mar. 17, 2017 (GB) ..... 1704253
Aug. 22, 2017 (GB) ..... 1713439

(51) Int. Cl.
*A47K 3/28* (2006.01)
*B05B 1/18* (2006.01)
*B05B 15/68* (2018.01)

(52) U.S. Cl.
CPC ..... *A47K 3/281* (2013.01); *B05B 1/18* (2013.01); *B05B 15/68* (2018.02)

(58) Field of Classification Search
CPC ..... E03D 9/002; E03C 1/06; E03C 1/066; A47K 3/281; B64H 2701/33; B05B 1/18;
(Continued)

(56) References Cited

U.S. PATENT DOCUMENTS 3,381,312 A 5/1968 Whitla
3,713,176 A 1/1973 Stock
(Continued)

FOREIGN PATENT DOCUMENTS

DE 298 13 597 U1 12/2005
DE 10 2009 053 732 A1 5/2011
(Continued)

OTHER PUBLICATIONS

PCT/GB2017/053314 International Search Report and Written Opinion, dated Jan. 31, 2018.
(Continued)

*Primary Examiner* — Erin Deery
(74) *Attorney, Agent, or Firm* — LIPPES MATHIAS LLP

(57) ABSTRACT

An apparatus {200} is provided for being mounted above a shower area (235) to be cleaned. The apparatus (200) has a nozzle head (209) for spraying cleaning fluid to clean the shower area (235), and a flexible conduit (223) through which the nozzle head (209) is arranged to receive the cleaning fluid, the flexible conduit (223) being connected to the nozzle head (200), The apparatus (200) also has a winder mechanism (238) for winding or unwinding a coil of the flexible conduit (223) about an axis (215). At least part (221) of the winder mechanism (238) is rotatable in one direction about the axis (215) to unwind the coil, and is rotatable in the opposite direction about the axis (215) to wind the coil. The nozzle head (209) has a first part (225) fixed to the flexible conduit (223) and a second rotatable part (231) arranged to rotate relative to the first part (225). When the apparatus (200) is mounted above the shower area (235) and the coil is unwound, the nozzle head (209) is lowered from the winder mechanism (236), and when the coil is then wound, the nozzle head (209) is raised up to the winder mechanism (236).

10 Claims, 15 Drawing Sheets

(58) Field of Classification Search
CPC ..... B05B 1/185; B65H 75/34; B65H 75/364; B65H 75/44; B65H 75/4402; B65H 75/4452; B65H 75/4455
USPC ..... 4/662; 29/214–224, 416–254; 239/214–224, 416–254
See application file for complete search history.

(56) References Cited

U.S. PATENT DOCUMENTS 3,742,520 A * 7/1973 Bernardi ..... E03D 9/002 4/662
3,747,129 A 7/1973 Dyar
4,151,965 A * 5/1979 Manabe ..... B65H 75/364 242/129
4,258,834 A * 3/1981 Hawley ..... H02G 11/02 191/12.2 R
4,786,213 A * 11/1988 Leppanen ..... B65H 75/364 405/303
4,872,225 A 10/1989 Wagner
5,027,450 A * 7/1991 Lang ..... A61H 33/6031 239/197
5,060,322 A 10/1991 Delepine
5,093,942 A * 3/1992 Lang ..... A61H 33/6036 239/197
5,236,126 A * 8/1993 Sawade ..... B05B 3/003 239/252
5,485,973 A * 1/1996 Nellessen, Jr. ..... B65H 75/364 242/386
6,550,080 B1 4/2003 Grewal
10,704,239 B2 * 7/2020 Abood ..... B65H 75/486
2010/0306912 A1 12/2010 McCabe
2014/0197250 A1 7/2014 Jeronimus
2016/0059269 A1 3/2016 Ronding
2016/0150919 A1 6/2016 Dickson

FOREIGN PATENT DOCUMENTS

EP 1 793051 A2 6/2007
EP 2 135 536 A1 12/2009
EP 2 767 347 A1 8/2014

OTHER PUBLICATIONS

GB 1718213.0 Search Report Under Section 17, dated Mar. 24, 2018.

* cited by examiner

APPARATUS FOR BEING MOUNTED ABOVE A SHOWER AREA

The present invention relates to an apparatus for being mounted above a shower area, such as a shower cubicle or stall, to be cleaned by the apparatus.

When a shower area is used, water marks and lime-scale can form in the shower area, and it takes much effort to remove these manually. It is also time consuming to manually clean a shower area.

It is an object of the present invention to provide an apparatus for improving the cleaning process of a shower area.

According to the present invention there is provided an apparatus for being mounted above a shower area to be cleaned, the apparatus comprising a nozzle head for spraying cleaning fluid to clean the shower area, a flexible conduit through which the nozzle head is arranged to receive the cleaning fluid, the flexible conduit being connected to the nozzle head, and a winding mechanism for winding or unwinding a coil of the flexible conduit about an axis, at least part of the winding mechanism being rotatable in one direction about the axis to unwind the coil, and being rotatable in the opposite direction about the axis to wind the coil, the nozzle head having a first part fixed to the flexible conduit and a second rotatable part arranged to rotate relative to the first part, wherein when the apparatus is mounted above the shower area and the coil is unwound, the nozzle head is lowered from the winding mechanism, and when the coil is then wound, the nozzle head is raised up towards or to the winding mechanism.

By the nozzle head being arranged to be lowered and raised and having a rotatable part, this enables at least walls of the shower area to be adequately sprayed with cleaning fluid. The apparatus can clean, for example, glass, tiled and stone surfaces.

The winding mechanism may be a motorized winding mechanism for winding or unwinding the coil. Thus, the apparatus may be automated making it easy to clean a shower area.

The second rotatable part of the nozzle head may have at least one first outlet positioned to cause the second rotatable part to rotate relative to the first part when pressurized cleaning fluid supplied to the nozzle head leaves the first outlet.

The second rotatable part of the nozzle head may be arranged to rotate relative to the first part of the nozzle head about a vertical axis when the apparatus is installed.

The first outlet may have a flow axis offset from a rotational axis of the second rotatable part. The rotational axis may be coincident with the vertical axis. The first outlet may be inclined in a downward direction away from the rotational axis.

The second rotatable part of the nozzle head may have a plurality of circumferentially spaced first outlets each with a flow axis disposed at an obtuse angle with respect to a radial direction. The radial direction may extend from a central axis of the nozzle head. The flow through all the first outlets may drive the second rotatable part in one direction. The angle of each first outlet may be to the same side of the radial direction. The first outlets may be positioned in the second rotatable part so that when cleaning fluid is emitted from all the first outlets the pressure of the emitted fluid is counterbalanced. This prevents the nozzle head from swinging.

The winding mechanism may comprise a coil holder for holding the coil. The coil holder may be rotatable about the axis to selectively wind or unwind the coil.

At least part of the winding mechanism may be rotatable about a vertical axis to selectively wind and unwind the coil when the apparatus is installed. By having a coil of the flexible conduit rotatable about a vertical axis, this minimises the height required to house at least the winding mechanism of the apparatus.

The winding mechanism may include a rotatable coil engagement portion rotatable in said one direction about the vertical axis to unwind the coil from the coil holder, and being rotatable in the opposite direction about the vertical axis to wind the coil into the coil holder.

The rotatable coil engagement portion may comprise a conduit guide for guiding the flexible conduit from the coil holder.

The rotatable coil engagement portion may comprise a coil support for the coil to rest on.

The coil holder may be rotatable about a horizontal axis to wind or unwind the coil when the apparatus is installed. The apparatus may include a coil holder horizontal displacement mechanism configured to move the coil holder in a horizontal direction. The coil holder horizontal displacement mechanism may be configured to move the coil holder in the horizontal direction such that during any part of the unwinding rotation of the coil holder the flexible conduit leaving the coil holder is in a position which does not laterally shift relative to other parts of the apparatus. This prevents the flexible conduit from getting bent and improves the flow of fluid through the flexible conduit.

The apparatus may include a connector for connecting the conduit to a supply of pressurized cleaning fluid.

The second rotatable part of the nozzle head may have at least one second outlet in a face distal to the first part of the nozzle head. The second outlet may have a flow axis offset from the rotation axis of the second rotatable part. The second outlet may be inclined in a downward direction away from the downward direction of the first outlet.

The second rotatable part of the nozzle head may have a magnetic bearing in relation to the first part of the nozzle head. This helps the second rotatable part to rotate easily relative to the first part.

The apparatus may include a housing for housing the nozzle head when the nozzle head is in a raised position. The housing may have an opening through which the conduit extends. The housing may have rollers for guiding the conduit through the opening. The housing may have a translucent or transparent inner lining positioned around the nozzle head when the nozzle head is in the raised position, and a light source above at least part of the inner lining.

The apparatus may include or be connected to a pump for supplying pressurized cleaning fluid to the nozzle head. The apparatus may include or be connected to at least one container for holding cleaning fluid to be supplied to the nozzle head. The pump and/or at least one container may not necessarily be mounted above the shower area.

The apparatus may include a shower head which includes at least the nozzle head which may be retracted into the shower head.

Embodiments of the present invention will now be described, by way of example, with reference to the accompanying schematic drawings, in which:

FIG. 1 is a view of an apparatus for being mounted above a shower area to be cleaned in accordance with an embodiment of the present invention;

FIGS. 2*a* and 2*b* are plan and sectional details of part of a top of a housing for a nozzle head of the apparatus;

Figure 1:
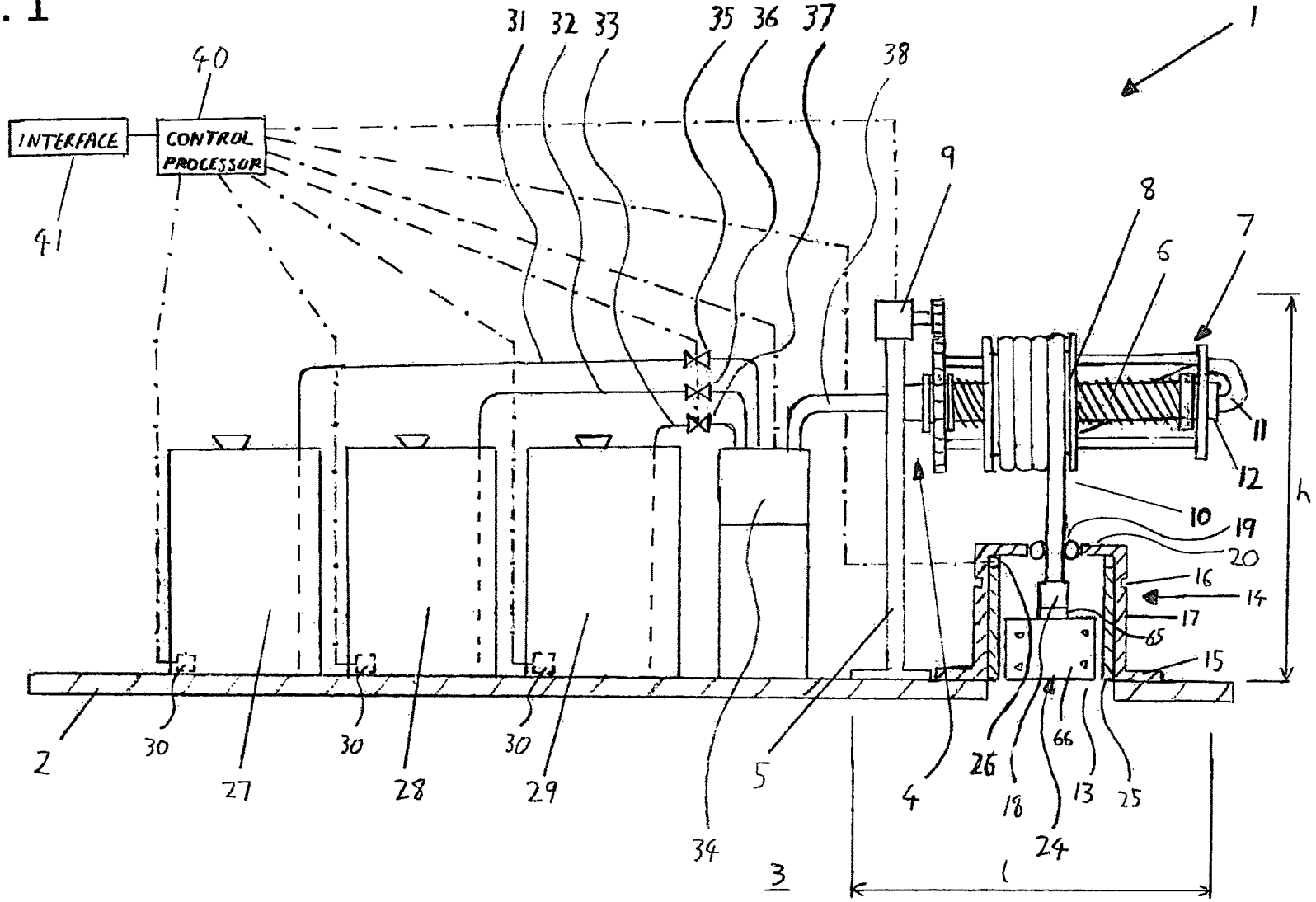

Referring to FIG. 1 of the accompanying drawings, an apparatus 1 for cleaning a shower area according to an embodiment of the invention is mounted on top of a ceiling 2 above the shower area 3 which may be a shower cubicle or stall.

A support 4 is mounted on top of the ceiling 2. The support 4 comprises a support column 5 and a support cylinder 6 cantilevering from the support column 5 above the ceiling 2. A reel mount 7 is rotatably mounted about the support cylinder 6 and a reel or spool or coil holder 8 is mounted on the reel mount 7. A motor 9 for rotating the reel 8 is mounted on top of the support column 5. A flexible conduit or hose 10 is wound on the reel 8 and a first end 11 of the flexible conduit 10 is connected to a portion 12 of the reel mount 7 distal from the support column 5.

Figure 2A:
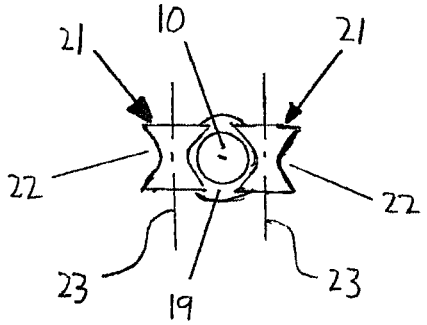
Figure 2B:
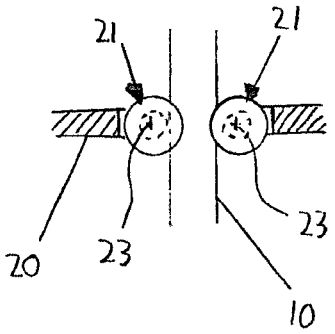
Figure 8:
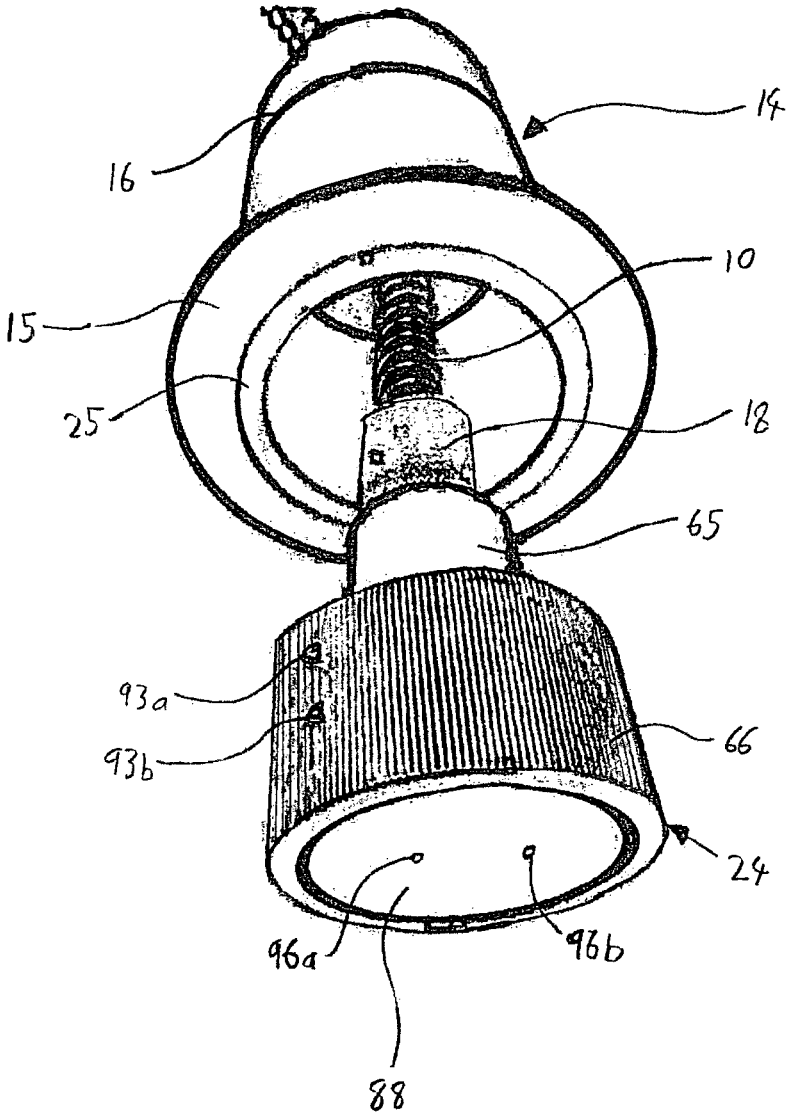
FIG. 8 is a perspective view of the nozzle head extending from beneath the housing.
Figure 9:
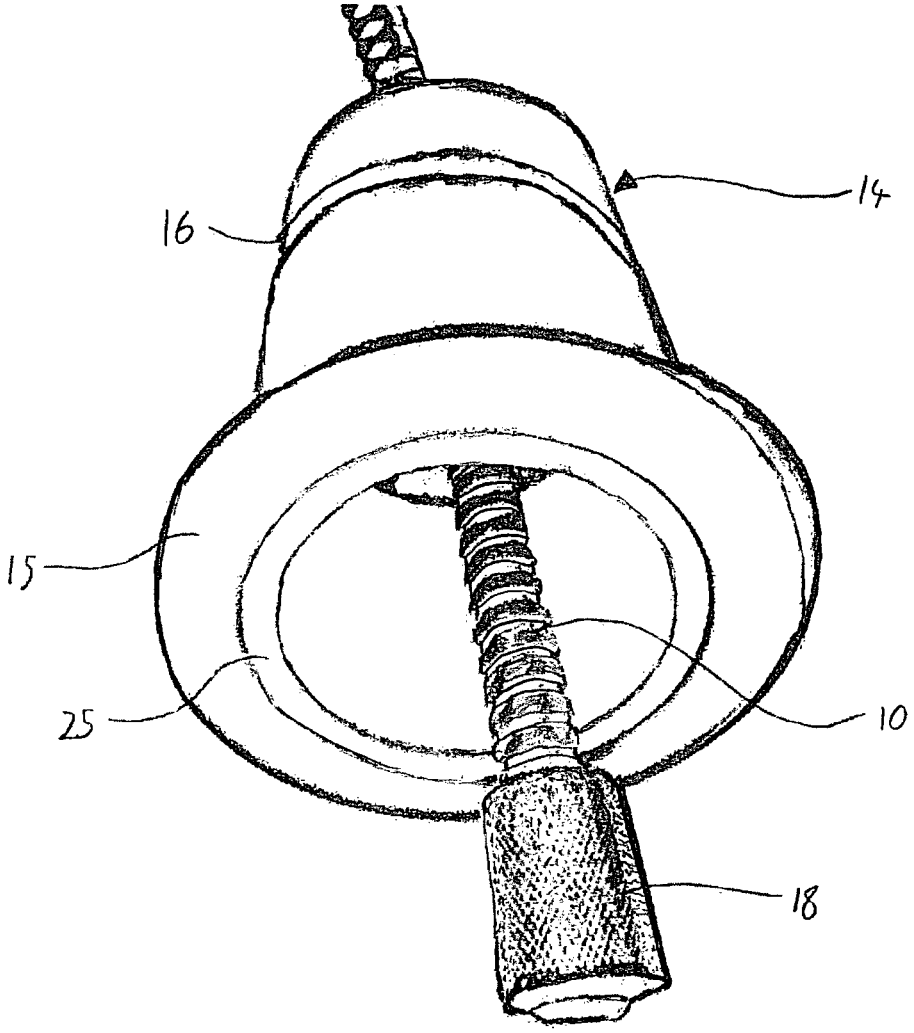
FIG. 9 is a perspective view similar to FIG. 8 with the nozzle head omitted.

The support 4 is located so that the support cylinder 6 is mounted above an opening 13 in the ceiling 2. A housing 14 (see also FIGS. 8 and 9) is mounted on top of the ceiling 2 above the opening 13. The housing 14 is cylindrical and has a bottom flange 15 to be mounted on the ceiling 2. An annular recess 16 extends around a side wall 17 of the housing 14 and the recess 16 can be used to receive a clamp (not shown) for clamping the housing 14 to the ceiling 2. A second end 18 of the flexible conduit 10 extends through an opening 19 in a top 20 of the housing 14 and the second end comprises a threaded connector 18. The housing 14 has a pair of rollers 21 in its top 20 for guiding the flexible conduit 10 through the opening 19 (see FIGS. 2*a* and 2*b*). The outer surface of each roller 21 comprises an annular groove 22 around the roller's axis of rotation 23 wherein the groove 22 is for guiding the flexible conduit 10. The flexible conduit threaded connector 18 is screwed to a nozzle head 24 (see also FIG. 8) wherein the nozzle head 24 is housed in the housing 14 when the nozzle head 24 is in a raised position. The housing 14 has a translucent inner lining 25 which is positioned around the nozzle head 24 when the nozzle head 24 is in the raised position. A light emitting diode (LED) 26 is located at a top of the inner lining 25.

Three containers or reservoirs 27, 28, 29 are mounted on top of the ceiling 2 and contain liquid to be sprayed from the nozzle head 24. The first container 27 is arranged to contain a cleaning liquid with a cleaning agent or cleaning chemicals. The cleaning agent or chemicals may be held in suspension in a liquid. The cleaning agent may comprise, chilled water, vinegar or a spirit based, highly volatile substance which includes a perfume. The second container 28 is arranged to contain hot water and the third container 29 is arranged to contain cold water. Each container 27, 28, 29 has a sensor 30 for sensing when the level of liquid in the container 27, 28, 29 is low. Each container 27, 28, 29 is connected by a respective pipe 31, 32, 33 to a pump 34 and each pipe 31, 32, 33 has a valve 35, 36, 37. An outlet of the pump 34 is connected by a pipe 38 to the support cylinder 6.

An electronic control processor 40 is connected to the motor 9, the LED 26, the container sensors 30, the pump 34 and the valves 35, 36, 37. An interface 41, which may comprise a keypad and a display screen, is connected to the electronic control processor 40.

Figure 3:
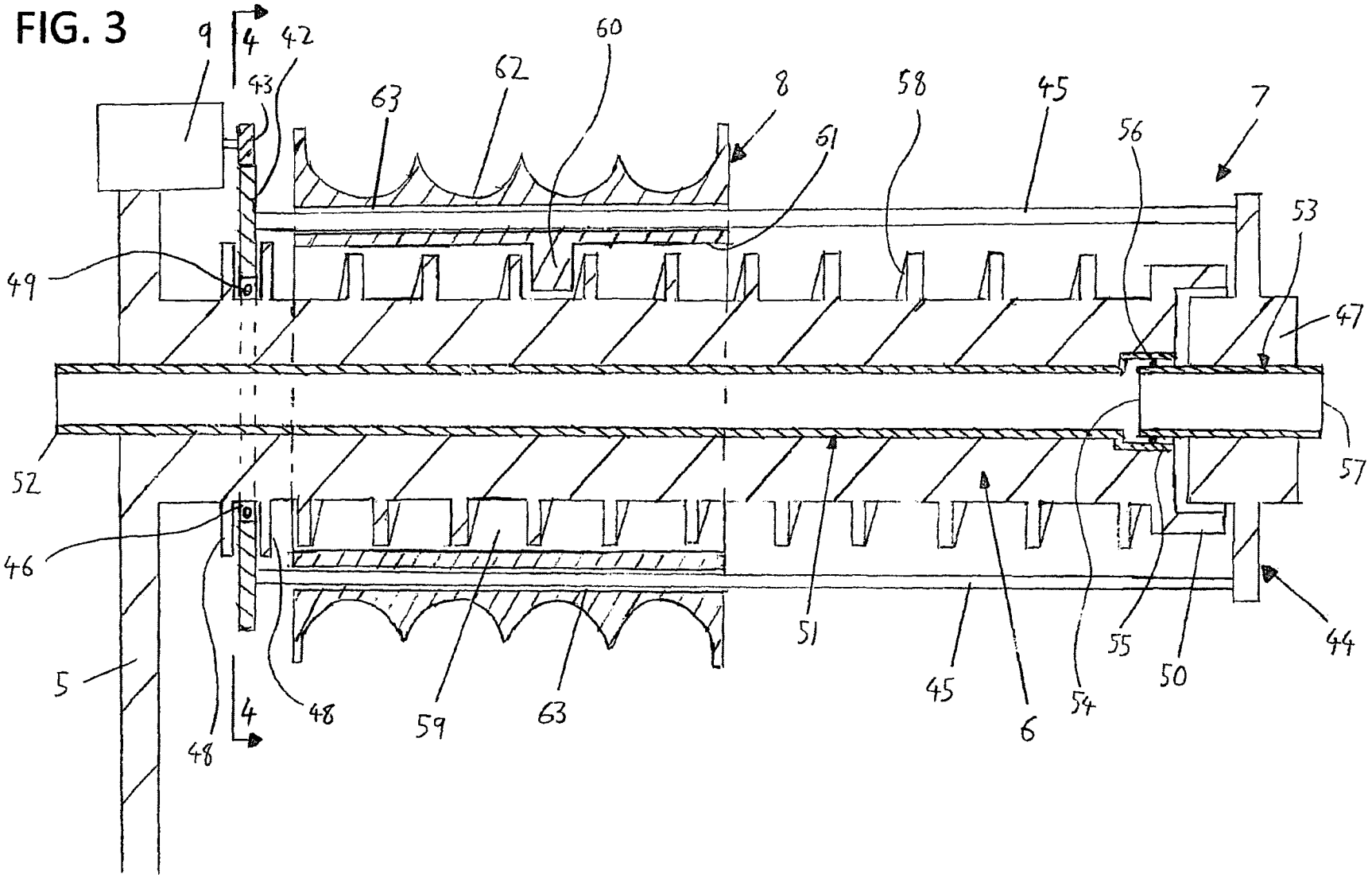
FIG. 3 is a sectional view of part of a support and a reel of the apparatus.
Figure 4:
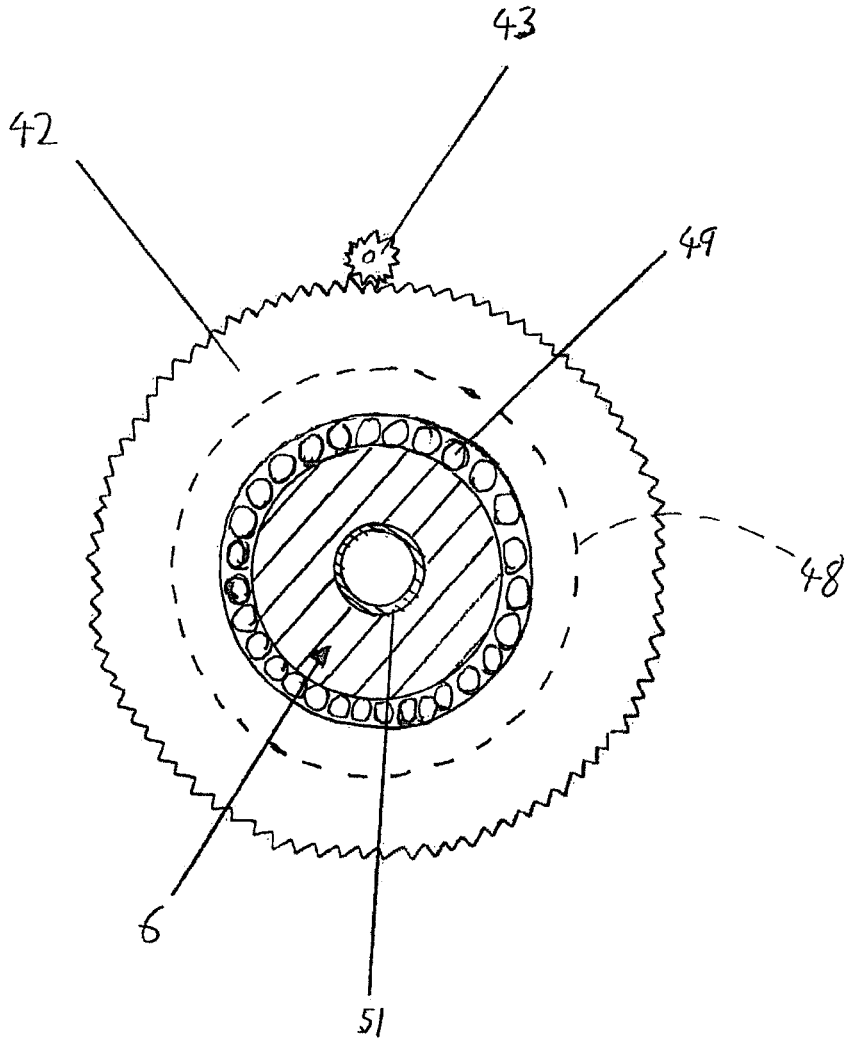
FIG. 4 is a sectional plan view taken along lines 4-4 of FIG. 3.

Referring to FIGS. 3 and 4, the reel mount 7 has an annular gear 42 which is axially restrained by a pair of flanges 48 which project from the support cylinder 6 and are adjacent the support column 5. Bearings 49 between the flanges 48 enable the annular gear 42 to rotate easily relative to the support cylinder 6. The annular gear 42 is engaged by a spur gear 43 of the motor 9 on the support column 5, and the reel mount 7 also has a disc 44. The disc 44 is spaced from the annular gear 42 by a plurality of highly polished rods 45 which are spaced close to the circumference of the annular gear 42 and the disc 44, respectively. The annular gear 42 has a central opening 46, and the disc 44 has a cylindrical mount 47 at its centre. The support cylinder 6 extends through the annular gear central opening 46. The distal end of the support cylinder 6 has an enlarged portion 50 forming a bearing into which the disc cylindrical mount 47 is journaled. A pipe 51 extends through the centre of the support cylinder 6 and is fixed tightly to the support cylinder 6. One end 52 of the pipe 51 extends beyond the support column 5 and has the pipe 38 from the pump 34 connected to it. Another pipe 53 extends through the centre of the disc cylindrical mount 47 and is fixed tightly to the cylindrical mount 47. One end 54 of the disc cylindrical mount pipe 53 is journaled into an enlarged end portion 55 of the support cylinder pipe 51 with there being a ring seal 56 in between. The opposite end 57 of the disc cylindrical mount pipe 53 has the first end 11 of the flexible conduit 10 attached to it. A screw thread 58 extends around the support cylinder 6 between the flanges 48 and the enlarged portion 50.

The reel 8 has a central cylindrical opening 59 through which the support cylinder 6 extends. A protrusion 60 on an inner surface 61 of the reel opening 59 engages the support cylinder screw thread 58. An outer surface 62 of the reel 8 comprises a helical groove shaped for receiving the flexible conduit 10 such that the flexible conduit 10 is wound onto the reel 8 in an orderly manner seated in the helical groove. Between the outer surface 62 and the inner surface 61 of the reel 8, rod passages 63 are spaced around the central cylindrical opening 59, wherein a respective rod 45 of the reel mount 7 extends through each rod passage 63.

Figure 5:
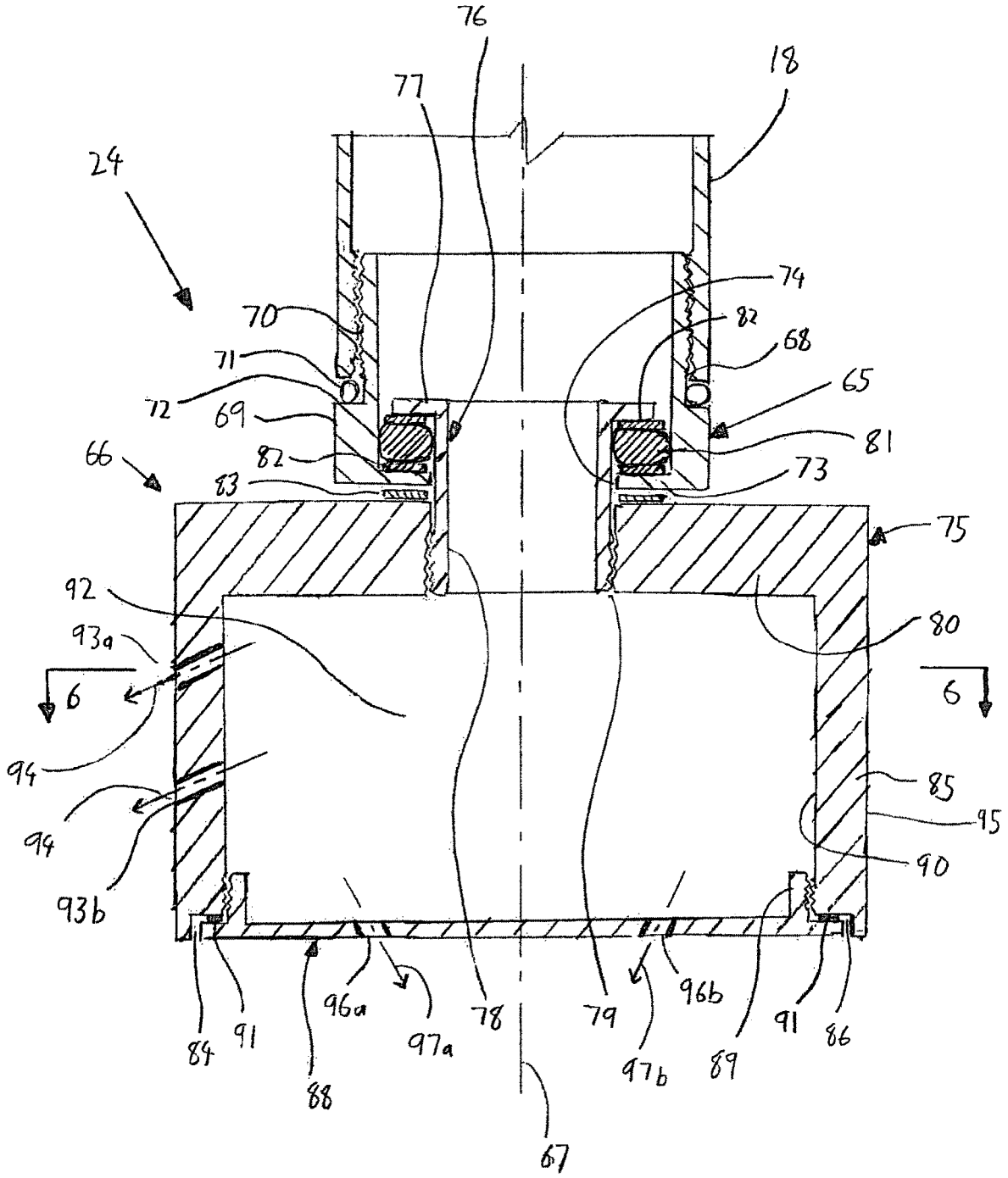
FIG. 5 is a sectional view of the nozzle head.

Referring to FIG. 5, the nozzle head 24 has a first part 65 and a second rotatable part 66 arranged to rotate relative to the first part 65 about a longitudinal or central axis 67 of the nozzle head 24. The nozzle head first part 65 is cylindrical in shape and has a recess 68 stepped into an outer surface 69 of the nozzle head first part 65 at one end wherein the recess 68 has a screw thread 70. The flexible conduit threaded connector 18 is screwed onto the screw thread 70 of the nozzle head first part 65, and there is a seal 71 between the flexible conduit threaded connector 18 and a shoulder 72 where the shoulder 72 forms the step of the recess 68 into the outer surface 69. The nozzle head first part 65 has an end wall 73 distal from the recess 68 and the end wall 73 has a central opening 74.

The nozzle head second part 66 has a cylindrical main body 75 of a larger diameter than the nozzle head first part 65 and a cylindrical fixing unit 76 of a smaller diameter than the nozzle head first part 65. The fixing unit 76 has a flange 77 at one end and extends through the end wall opening 74 of the nozzle head first part 65. The opposite end 78 of the fixing unit 76 is screwed into a central opening 79 in an end wall 80 of the cylindrical main body 75. Between the fixing unit flange 77 and the nozzle head first part end wall 73 is a ring seal 81 sandwiched between two washers 82. Between the nozzle head first part end wall 73 and the cylindrical main body end wall 80 is a washer 83. The end 84 of the cylindrical main body 75 distal from the end wall 80 is open and an annular side wall 85 extends between the end wall 80 and the opposite open end 84. The bottom of the side wall 85 adjacent the open end 84 has an inner annular recess 86 for receiving a circular cover 88. The circular cover 88 has an annular ridge 89 close to its circumference and the annular ridge 89 is screwed to an inner surface 90 of the cylindrical main body side wall 85 adjacent the annular recess 86 so that the cover 88 is flush with the end 84 of the cylindrical main body 75. The cover 88 forms a face distal to the nozzle head first part 65. A ring seal 91 is sandwiched between the cover 88 and the annular recess 86. Thus, the cylindrical main body 75 has a chamber 92 bounded by the end wall 80, the side wall 85 and the cover 88.

Figure 6:
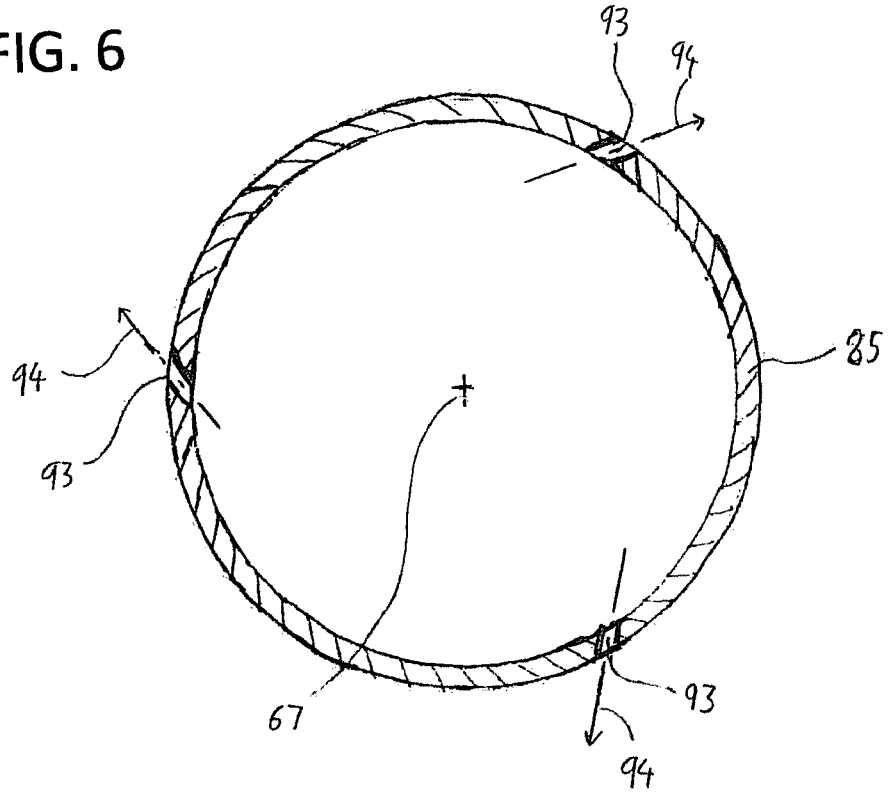
FIG. 6 is a sectional plan view taken along lines 6-6 of FIG. 5.

The annular side wall 85 has three pairs of first outlets 93 equally spaced along the wall 85. One outlet 93*a* of each pair is directly above the other outlet 93*b* of the pair. Each side wall outlet 93 has a flow axis 94 and the flow axis 94 of at least some and preferably all the outlets 93 are offset from the longitudinal axis 67 of the second rotatable part 66. Viewed from above (see FIG. 6) the flow axis 94 of each side wall outlet 93 is inclined at an acute angle to a tangent to the side wall 85 where the outlet is situated. Each such flow axis 94 also extends through the annular side wall 85 in a clockwise direction. In an alternative arrangement each flow axis may extends through the annular side wall 85 in an anticlockwise direction. The flow axis 94 of each side wall outlet 93 is also inclined at a slight angle downwardly from the inner surface 90 of the side wall 85 to an outer surface 95 of the side wall 85.

Figure 7:
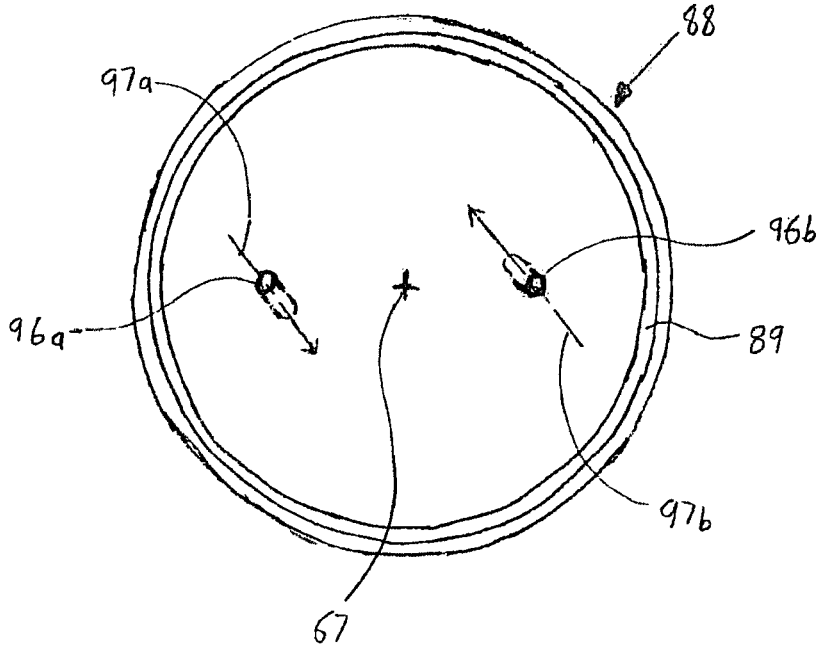
FIG. 7 is a plan view of a cover at the base of the nozzle head.

The circular cover 88 has a pair of second outlets 96*a*, 96*b* inclined downwardly at an acute angle to the plane of the cover 88. Each cover outlet 96*a*, 96*b* has a flow axis 97*a*, 97*b* and the flow axis of both the outlets is offset from the longitudinal axis 67 of the second rotatable part 66. With respect to the longitudinal axis 67, the flow axes 97*a*, 97*b* (see FIG. 7) are at 180° to each other. The direction of flow of liquid to be emitted is indicated by an arrow at the head of the flow axis 94 of each of the side wall outlets 93 and the flow axes 97*a*, 97*b* of the cover outlets 96*a*, 96*b*. The flow axis 97*a*, 97*b* of each cover outlet 96*a*, 96*b* is arranged so that the direction of flow of liquid along them would be in the opposite rotational direction to the direction of flow of liquid along the flow axes 94 of the side wall outlets 93 (see FIGS. 6 and 7).

In use, the valves 35, 36, 37 between the containers 27, 28, 29 and the pump 34 are initially set to be closed, and the nozzle head 24 is in the retracted raised position inside the housing 14. A user activates the cleaning cycle using the interface 41 and the electronic control processor 40 activates the LED 26 so that it flashes for a set period of time indicating that the cleaning cycle is about to start.

At the same time the processor 40 activates the motor 9 to rotate the annular gear 42 in one direction. As the annular gear 42 rotates about the support cylinder 6, the reel 8 is caused to rotate by the reel mount rods 45 between the annular gear 42 and the disc 44. This causes the nozzle head 24 to be lowered from the housing 14 and through the ceiling opening 13 as the flexible conduit 10 is begun to be unwound from the reel 8. The nozzle head 24 is lowered until it reaches an upper spray position. The reel 8 and reel mount 7 may comprise at least part of a winding mechanism for lowering the nozzle head 24.

Figure 10:
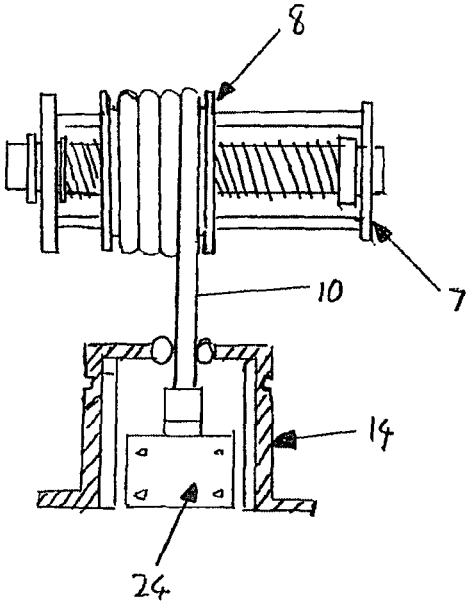
FIG. 10 is a detail of FIG. 1 showing the reel before it is translated in a horizontal direction.
Figure 11:
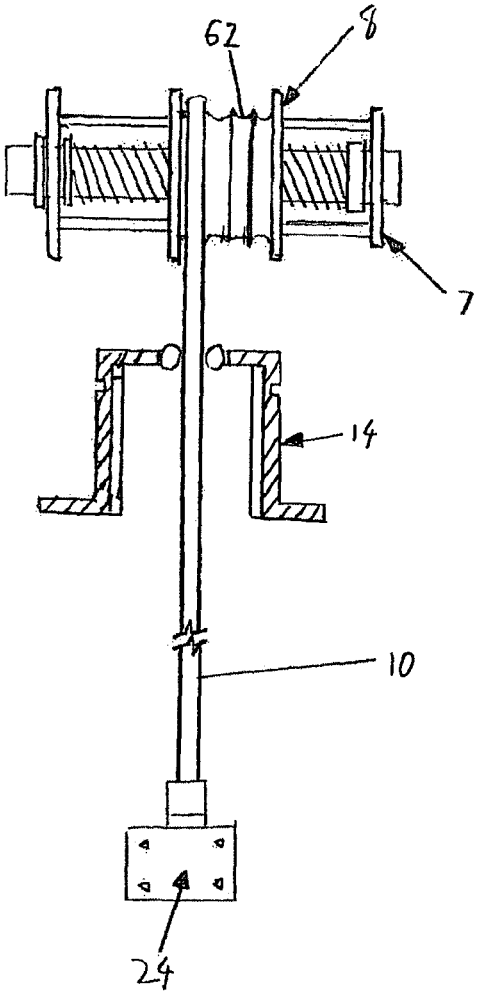
FIG. 11 is a detail similar to FIG. 10 with the reel translated in the horizontal direction.
Figure 12:
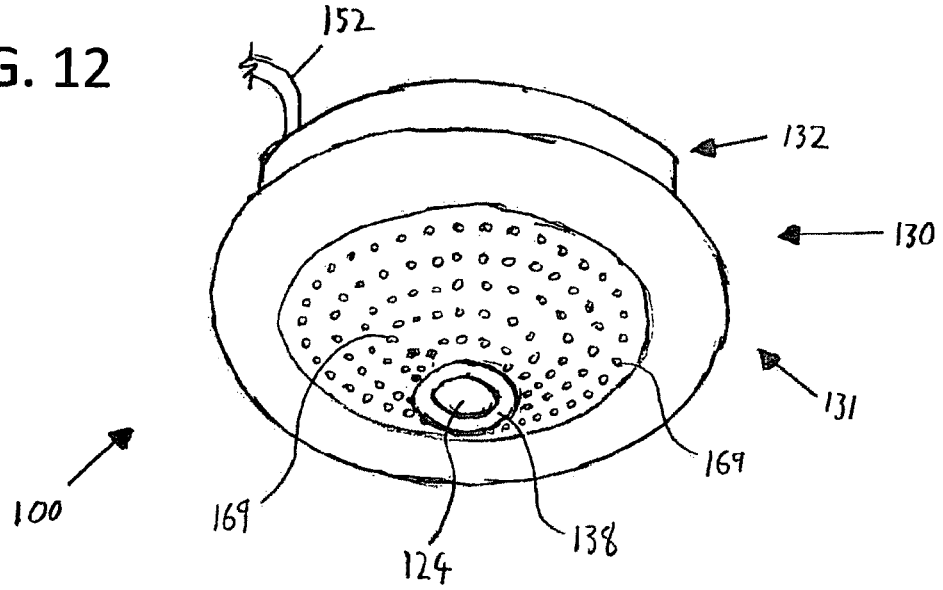
FIGS. 12 and 13 are perspective views of a casing comprising part of a modified apparatus.
Figure 13:
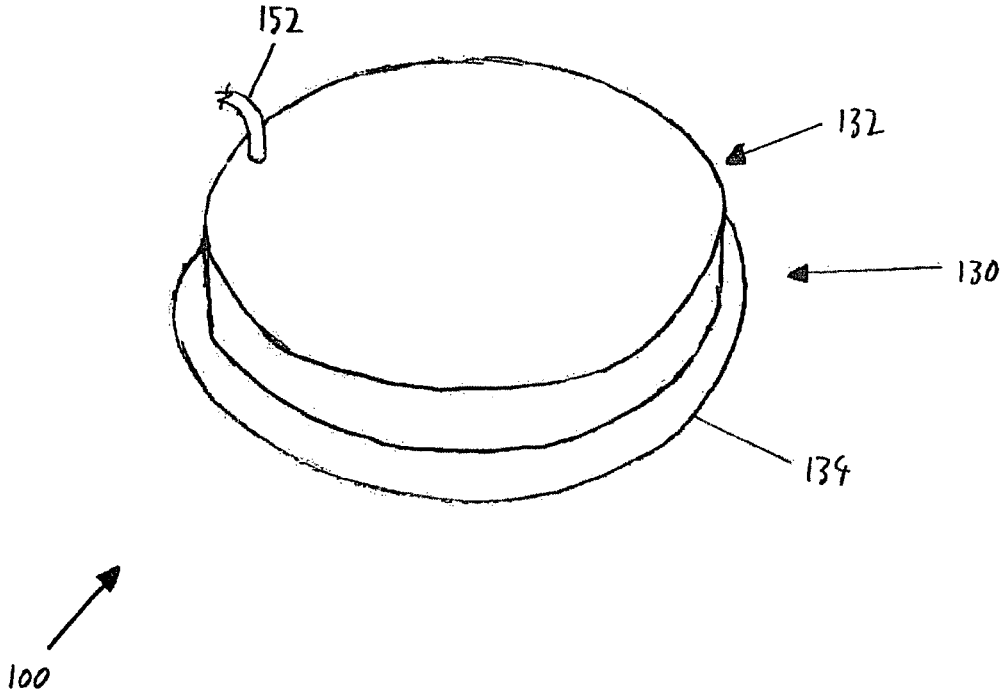
Figure 14:
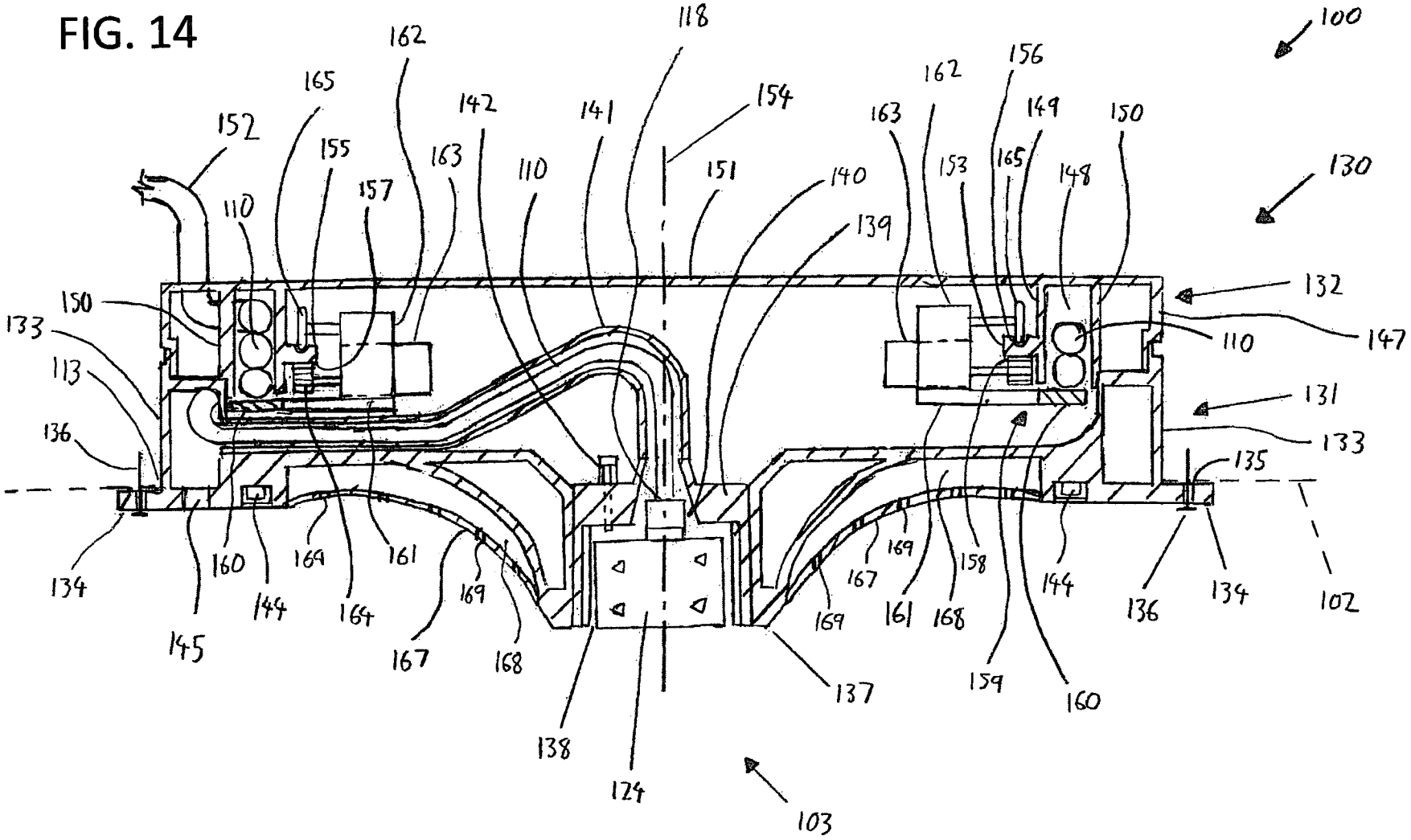
FIG. 14 is a cross-sectional view through the casing of FIGS. 12 and 13.
Figure 15:
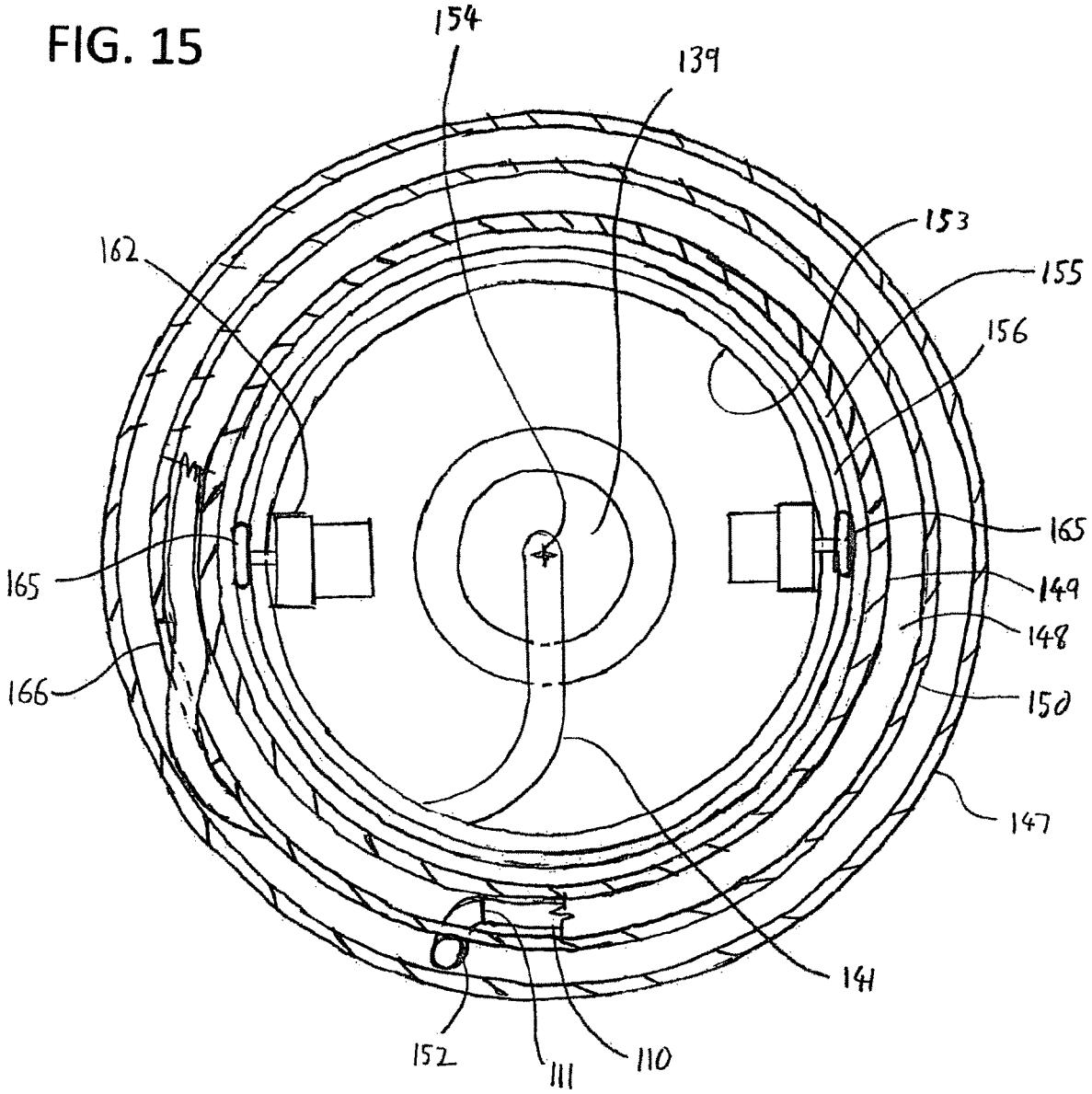
FIG. 15 is a plan sectional view through the casing.
Figure 16:
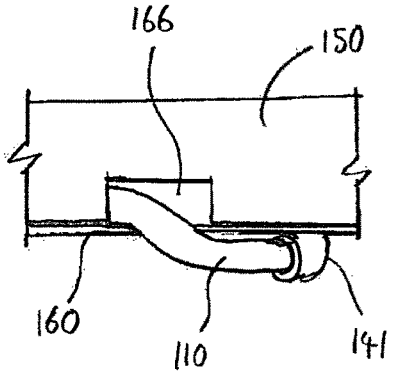
FIG. 16 is an outer view of a portion of an outer channel wall of the casing.

The reel inner surface protrusion 60 engaged with the support cylinder screw thread 58 causes the reel 8 to slide easily along the highly polished rods 45 in a horizontal direction towards the disc 44. The reel 8 is translated by a sufficient amount in the horizontal direction when the reel 8 is rotated so that the flexible conduit 10 beneath the reel 8 remains substantially stationary in the horizontal direction as shown in FIGS. 10 and 11. Thus, the flexible conduit 10 is not inclined between the reel 8 and the opening 19 at the top 20 of the housing 14. The support cylinder screw thread 58 and reel inner surface protrusion 60 may comprise at least part of a reel horizontal displacement apparatus.

The LED 26 is then set to be continually lit. The electronic control processor 40 causes the valve 35 between the first container 27 and the pump 34 to be opened and for the pump 34 to be activated to pump cleaning liquid from the first container 27 to the nozzle head 24 via the first container pump pipe 31, the pump support pipe 38, the support cylinder pipe 51, the cylindrical mount pipe 53 of the reel mount disc 44, and the flexible conduit 10 wherein the cleaning liquid is pressurized by the pump 34. The seal 56 between the support cylinder pipe 51 and the cylindrical mount pipe 53 provides a waterproof seal when the real mount 7 is rotated relative to the support cylinder 6. A connector for connecting the flexible conduit 10 to a supply of pressurized cleaning fluid may comprise the pump support pipe 38, the support cylinder pipe 51, and the cylindrical mount pipe 53 of the reel mount disc 44.

At the same time, motor 9 continues to rotate the annular gear 42 in the same direction causing the nozzle head 24 to be lowered towards a base of the shower area 3 until it reaches a lower spray position.

The pressurized cleaning liquid leaving the flexible conduit 10 presses the fixing unit flange 77 of the second rotatable part 66 of the nozzle head 24 towards the end wall 73 of the nozzle head first part 65 compressing the ring seal 81 in between to provide a watertight seal. The pressurized cleaning liquid enters the chamber 92 of the main cylindrical body 75 of the nozzle head rotatable part 66 and leaves via the side wall outlets 93 and the cover outlets 96. The pressurized cleaning liquid leaving the side wall outlets 93 causes the second rotatable part 66 of the nozzle head 24 to rotate relative to the nozzle head first part 65 about the longitudinal axis 67. As the nozzle head 24 at the second end 18 of the flexible conduit 10 is lowered directly downwards, the longitudinal or rotational axis 67 is a vertical axis. The washers 82, 83 minimize friction as the second rotatable part 66 rotates relative to the first part 65. As the nozzle head 24 is lowered, the pressurized cleaning liquid leaving the side wall outlets 93 of the rotating second rotatable part 66 causes walls of the shower area 3 to be cleaned with cleaning liquid.

The pressurized cleaning liquid leaving the cover outlets 96 causes the base of the shower area 3 to be cleaned with cleaning liquid as the nozzle head 24 approaches the base. Since the direction of flow of liquid from the cover outlets 96*a*, 96*b* is away from the direction of flow from the side wall outlets 93, this regulates the rotational speed of the second rotatable part 66 of the nozzle head 24. The arrangement of the outlets 93, 96*a*, 96*b* and the pressure of liquid emitted from the outlets 93, 96*a*, 96*b* prevents the nozzle head 24 from swinging.

After the motor 9 has rotated the annular gear 42 a sufficient number of times in one direction so that the nozzle head 24 has been lowered to the lower spray position, the central electronic processor 40 causes the motor 9 to rotate the annular gear 42 in the opposite direction so that the flexible conduit 10 is wound back around the reel 8 and the nozzle head 24 is raised back to the upper spray position. As the nozzle head 24 is raised, the second rotatable part 66 continues to rotate. The first container pump valve 35 is then closed, the pump 34 is stopped, and the second rotatable part 66 stops rotating.

After a set period of time (say 2 to 5 minutes) has passed, the respective valves 36, 37 between the second container 28 and the pump 34 and the third container 29 and the pump 34 are opened. The pump 34 is activated to pump hot and cold water from the containers 28, 29 to the nozzle head 24 as the nozzle head 24 is lowered to the lower spray position, and the second rotatable part 66 of the nozzle head 24 rotates as it sprays pressurized hot and cold water to rinse the cleaning liquid from the shower area, the hot and cold water also acting as a cleaning liquid. The nozzle head 24 is then raised back to the upper spray position. The electronic control processor 40 causes the motor 9 to rotate the annular gear 42 at, say, half the speed of the cleaning liquid cycle so that nozzle head 24 is lowered and raised at half the speed to ensure that the shower area 3 receives a thorough rinse. The second and third container pump valves 36, 37 are now closed and the pump 34 is stopped.

After another set period of time (say 2 to 5 minutes) has passed, the above process is repeated to provide a second rinse.

When this has been completed, the nozzle head 24 is then retracted into the housing 14, and the LED 26 is switched off to indicate the end of the cleaning process.

In a specific example of a preferred embodiment, the motor 9 is a 12 volt dc multi-speed motor. The pump 34 is a high pressure water pump pumping liquid and liquid is emitted from the nozzle head 24 at a pressure of about 2.5 bar. The support 4, reel 8 and housing 14 may be fitted into a space having a height h (see FIG. 1) of not more than 250 mm above the ceiling. The combined length l (see FIG. 1) of the support 4 including the support cylinder 6 and the reel mount 7 is not more than 250 mm. The washers 82, 83 are of polyester or any other hard synthetic composite material to provide minimal friction. The support cylinder pipe 51 and the disc cylindrical mount pipe 53 are of copper and the seals 56, 71, 81, 91 are of rubber.

Whilst the motor 9 is set to rotate the annular gear 42 a set number of times to lower or raise the nozzle head 24 a specified distance, the nozzle head 24 may have one or more sensors to detect its position wherein the sensor(s) is in communication with the electronic control processor 40 which controls the motor 9 accordingly.

A modified shower area cleaning apparatus 100 is illustrated in FIGS. 12 to 18. The modified shower area cleaning apparatus 100 has a disc-shaped casing 130 to be inserted into an opening 113 in the ceiling 102 above the shower area 103. The casing 130 includes components connected to the containers 27, 28, 29 via the pump 34 and to the electronic control processor 40 (shown in FIG. 1). The casing 130 comprises a lower casing part 131 and an upper casing part 132.

The lower casing part 131 has an outer wall 133 which is received in the ceiling opening 113 and a flange 134 which extends beyond the outer wall 133 and beyond the opening 113. The flange 134 has holes 135 for receiving screws 136 to fix the casing 130 to the ceiling 102. The lower casing part 131 has a central part 137 extending downward from the flange 134 with an annular curved portion 167 between the central part 137 and the flange 134. The annular curved portion 167 has a void 168 above it and the annular curved portion 167 has a plurality of openings 169 through it from the void 168 above. The central part 137 has a cavity 138 for housing the nozzle head 124 when the nozzle head 124 is in its raised position. The cavity 138 has an end wall 139 having an opening 140 for receiving the flexible conduit 110 which is connected to the nozzle head 124. The cavity end wall opening 140 is connected to a guidance pipe 141 which is above the central part 137 and extends towards the outer wall 133.

The cavity end wall 139 has a contact switch 142 extending through it which is connected to the electronic control processor 40 wherein the contact switch 142 is provided for resetting software for the processor 40. An underside of the lower casing part 131 has LED strip lights 144 with diffusers. The underside houses at least one sensor 145, such as a passive infrared sensor, connected to the electronic control processor 40 wherein the sensor 145 is for detecting if someone is in the shower cleaning area 103 below the casing 130. If this occurs, the processor 40 will prevent the cleaning operation from occurring.

The upper casing part 132 has an outer wall 147 which is connected to the lower casing part outer wall 133. The upper casing part 132 has a channel 148 defined by an inner channel wall 149 and an outer channel wall 150 extending downward from a roof 151 of the upper casing part 132. A pipe connector 152 extends from the outer channel wall 150 to an outside of the upper casing part 132 and the pipe connector 152 is arranged to be connected to the pump 34. The inner channel wall 149 has a flange 153 extending inwardly towards a vertical axis 154 of the casing 130. An upper surface 155 of the flange 153 has an annular groove 156, and a lower surface 157 of the flange 153 has an annular rack 158.

A rotatable part 159 is positioned between the lower and upper casing parts 131, 132. The rotatable part 159 has a ring 160 that is beneath the upper casing part channel 148. A pair of arms 161 extends inwardly from the ring 160 and a motor housing 162 is mounted on each arm 161. Each motor housing 162 has a motor 163 connected to the electronic control processor 40, and each motor 163 has a gear wheel 164 for engaging the rack 158 on the lower surface 157 of the inner channel wall flange 153. A roller 165 extends from each motor housing 162 above the motor 163 and the roller 165 is arranged to run in the annular groove 156 in the upper surface 155 of the inner channel wall flange 153. The rotatable part 159 is thus supported by the upper casing part 132 since the inner channel wall flange 153 of the upper casing part 132 is sandwiched between the rollers 165 and the gear wheels 164 of the rotatable part 159.

The flexible conduit 110 is stored as a coil in the channel 148 of the upper casing part 132 wherein the base of the coil rests on the ring 160 beneath the channel 148. The ring 160 may comprise at least part of a coil support. The channel 148 may comprise at least part of a coil holder. The first end 111 of the conduit 110 is connected to the pipe connector 152. The flexible conduit 110 extends through an opening 166 in the outer channel wall 150, under the ring 160 and through the guidance pipe 141 to the cavity end wall opening 140. The flexible conduit 110 extends through the cavity end wall opening 140 so that the second end 118 of the flexible conduit 110 is connected to the nozzle head 124.

Figure 17:
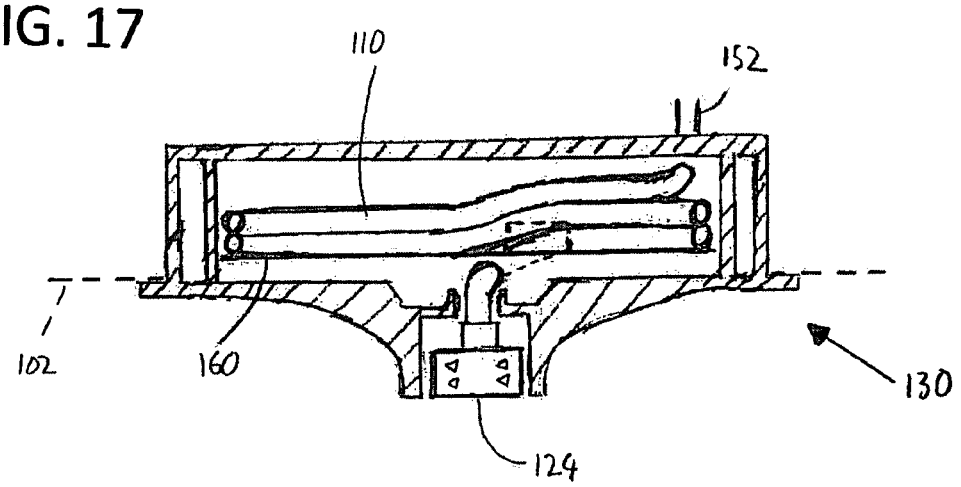
FIGS. 17 and 18 are sectional views respectively showing the nozzle head in the casing and the nozzle head lowered from the casing.
Figure 18:
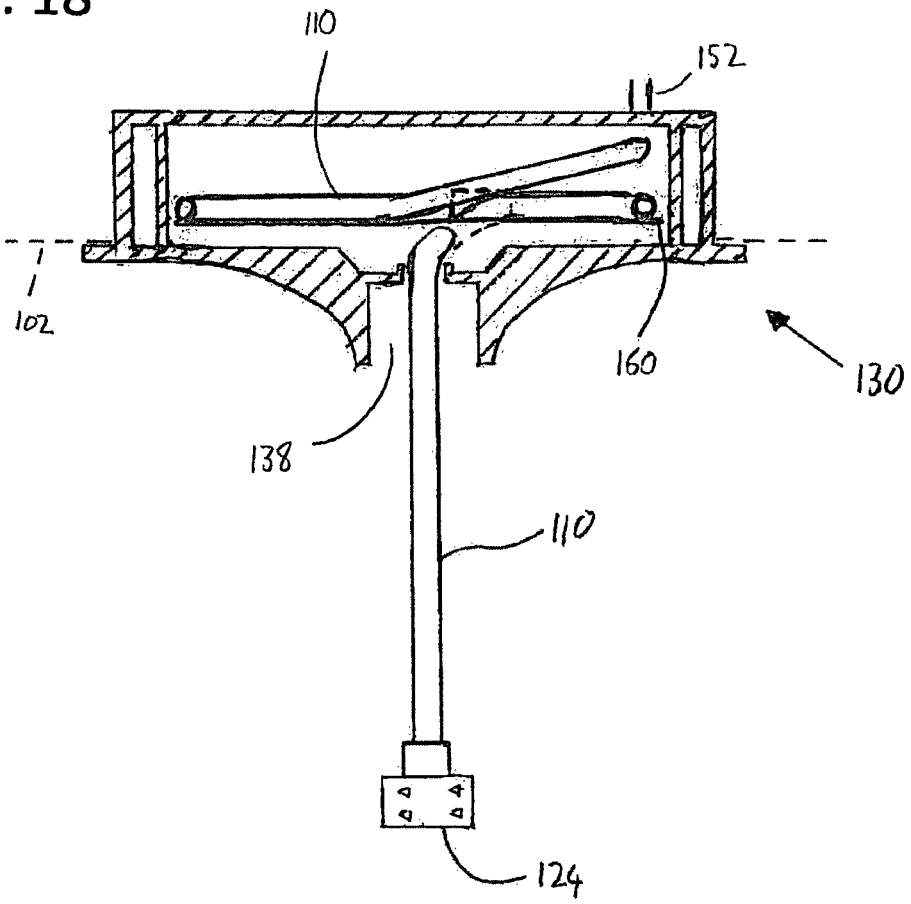

Referring particularly to FIGS. 17 and 18, wherein the inner channel wall 149 of the upper casing part 132 and the motors 163 and housing 162 are omitted for clarity, the nozzle head 124 is initially in the raised position where it is housed in the cavity 138 of the lower casing part 131.

To lower the nozzle head 124, the electronic control processor 40 activates the motors 163 (see FIG. 14) to rotate the gear wheels 164. The gear wheels 164 engage the rack 158 on the lower surface 157 of the inner channel wall flange 153 which causes the ring 160 to rotate about the vertical axis 154 relative to the upper casing part channel 148. As the ring 160 rotates, the coil of the flexible conduit 110 on the ring 160 and in the channel 148 unwinds. This causes the nozzle head 124 to be lowered from the cavity 138 as the unwound part of the flexible conduit 110 extends from the outer channel wall opening 166 (see FIG. 16) and through the guidance pipe 141. Reversing the direction of rotation of the ring 160 causes the flexible conduit 110 to be wound back into the channel 148 and the nozzle head 124 to be retracted back into the cavity 138. The rotatable part 159 may comprise at least part of a winding mechanism.

The modified shower area cleaning apparatus 100 can also comprise a shower head. A supply of water (not shown) is connected to the openings 169 in the annular curved part 167 of the lower casing part 131 so that a spray of water can clean a person in the shower area 103. The supply of water can be controlled via the electronic control processor 40. Thus, the casing 130 or a housing for holding the winding mechanism may also comprise a shower head.

Figure 19:
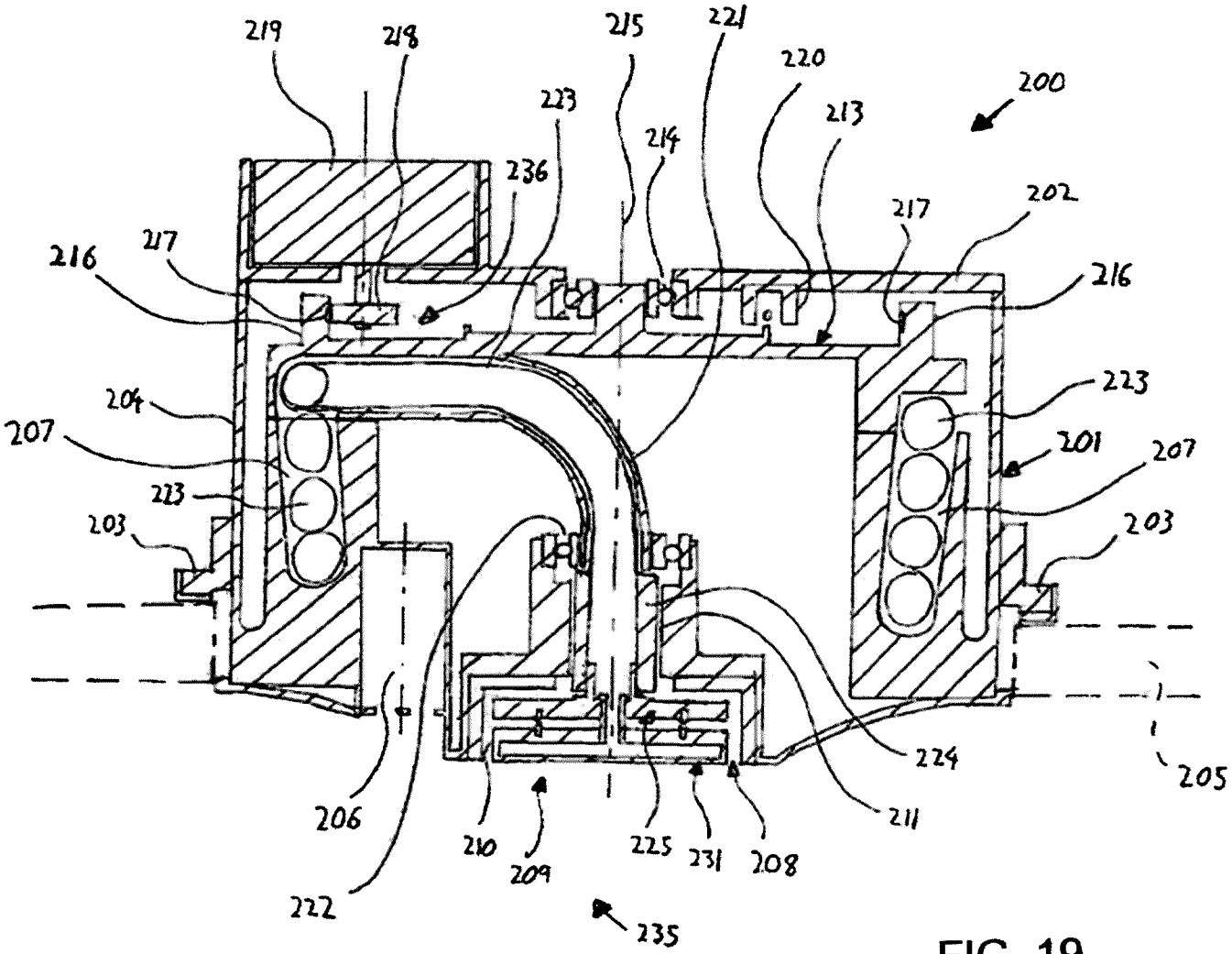
FIG. 19 is a cross-sectional view of a casing of part of another modified apparatus.
Figure 20:
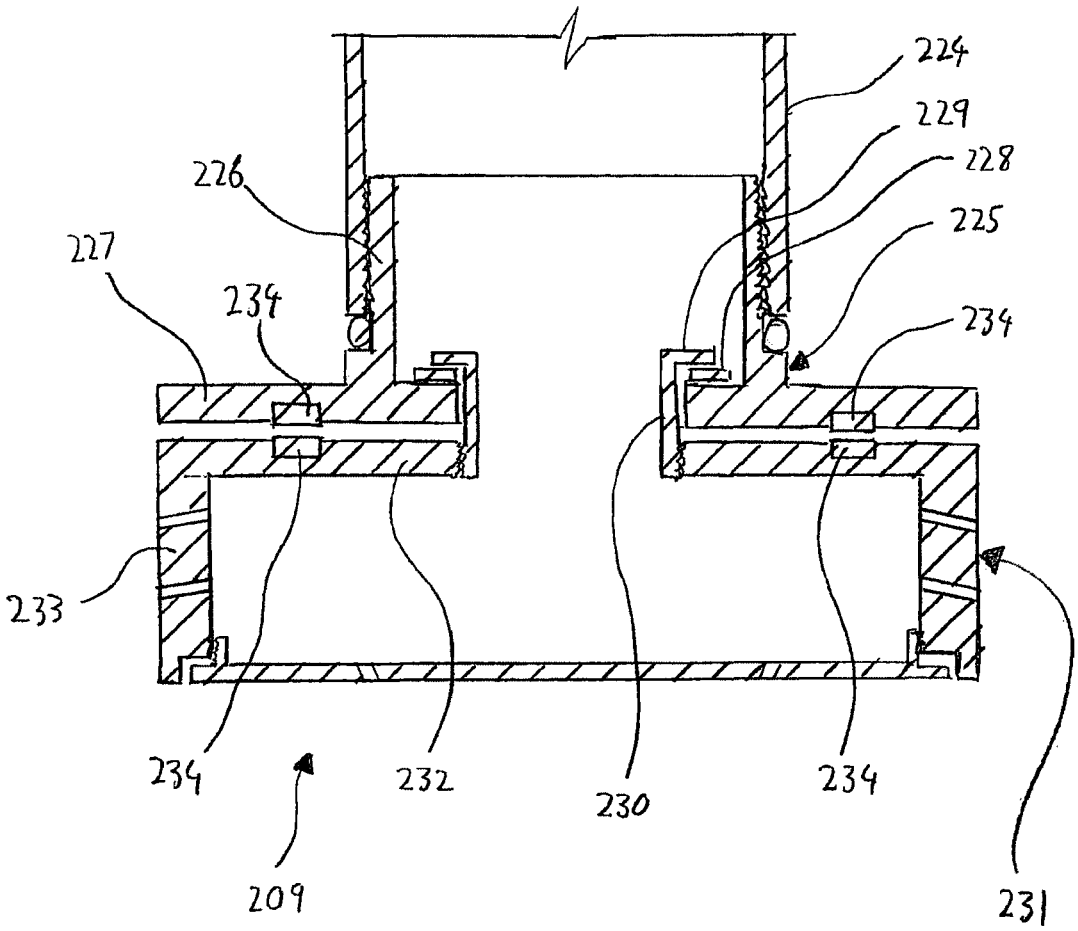
FIG. 20 is a sectional view of the nozzle head of the apparatus of FIG. 19.

A modification of the shower area cleaning apparatus 100 is illustrated in FIGS. 19 and 20. The modified shower area cleaning apparatus 200 has a cylindrical casing or unit main housing 201 wherein a top portion 202 of the housing 201 is removable. The unit main housing 201 has adjustable fixing brackets 203 connected to the outside of its outer wall 204 to fix the housing 201 to an upper side of the ceiling 205. An underside of the unit main housing 201 has a recess 206 for housing a sensor such as a passive infrared sensor.

The unit main housing 201 has an annular channel 207 which forms a coil holder wherein the channel 207 is inclined slightly to the vertical so that the diameter of the centre line of the channel at its base is smaller than the diameter of the centre line of the channel at the top of the channel 207. A pipe connector (not shown) extends from a bottom of the channel 207 to an outside of the unit main housing 201 and the pipe connector is arranged to be connected to the pump 34. The central part of a base of the unit main housing 201 has a stepped cavity 208 for housing the nozzle head 209 when the nozzle head 209 is in its raised position wherein a lower portion 210 of the cavity 208 has a larger diameter than an upper portion 211 of the cavity 208.

A circular rotatable part 213 is positioned above the channel 207 and beneath the top portion 202. The rotatable part 213 is connected to the top portion 202 via a ball bearing connection 214 so that the rotatable part 213 is rotatable about the vertical axis 215 of the cylindrical unit main housing 201. The rotatable part 213 has an upper annular wall 216 wherein the inside surface of the wall 216 comprises a rack 217 that is engaged by a gear 218 that is driven by a motor 219, such as a stepper motor, which is housed in the top portion 202 above the rotatable part 213. A rotational speed decoder 220 is positioned in the top portion 202 above the rotatable part 213, and the rotational speed decoder 220 and the motor 219 are connected to the electronic control processor 40. The rotatable part 213 has a conduit guide pipe 221 that extends radially from above the unit main housing channel 207 and then bends downwards so that it is connected to the top of the cavity upper portion 211 by a ball bearing connection 222.

The flexible conduit 223 is stored as a coil in the unit main housing channel 207 wherein the base of the coil rests at the bottom of the channel 207. The channel 207 may comprise at least part of a coil holder. The first end of the conduit 223 is connected to the pipe connector. The flexible conduit extends 223 through the conduit guide pipe 221 and has the threaded connector 224 at the second end of the conduit 223.

The nozzle head first part 225 has a cylindrical portion 226 with the end wall 227 of the nozzle head first part 225 extending beyond the cylindrical portion 226 to form an outer circular flange as well as within the cylindrical portion 226. The cylindrical portion 226 has the threaded connector 224 at the second end of the conduit 223 screwed onto it. A washer 228 is sandwiched between the flange 229 of the fixing unit 230 of the nozzle head second part 231 and the part of the end wall 227 within the cylindrical portion 226. The fixing unit 230 is screwed to the end wall 232 of the cylindrical main body 233 of the nozzle head second part 231 and both the nozzle head second part end wall 232 and the nozzle head first part end wall 227 have magnets 234 facing each other wherein the magnets 234 repel each other so that the second part 231 has a magnetic bearing with the first part 225. This enables the nozzle head second part 231 to rotate relative to the nozzle head first part 225 with little friction. The magnets 234 are preferably neodymium magnets.

To lower the nozzle head 209 towards the bottom of the shower area 235, the electronic control processor 40 activates the motor 219 to rotate the rotatable part 213 relative to the unit main housing 201 about the vertical axis 215. The processor 40 can monitor the rotation of the rotatable part 213 via the rotational speed decoder 220. As the rotatable part 213 rotates, the conduit guide pipe 221 rotates so that the coil of the flexible conduit 223 in the channel 207 is unwound causing the nozzle head 209 to be lowered. Reversing the direction of rotation of the rotatable part 213 causes the flexible conduit 223 to be wound back into the channel 207 and the nozzle head 209 to be retracted back into the cavity 208. The rotatable part 213 with its conduit guide pipe 221 may comprise at least part of a winding mechanism 236.

Whilst particular embodiments have been described, it will be understood that various modifications may be made without departing from the scope of the claimed invention.

The containers 27, 28, 29 and pump 34 do not need to be located above the ceiling but they may be located elsewhere in a building remote from the shower area. The containers and pump may be located, say, 5 to 10 metres from the shower area.

The outlets 93, 96*a*, 96*b* are shown as fixed but they may be adjustably mounted so that the direction of their flow axes 94, 97*a*, 97*b* can be varied. The nozzle head may have any suitable number of outlets. The flow axis 97*a*, 97*b* of each cover outlet 96*a*, 96*b* may be arranged so as the direction of flow of liquid along them would be in the same rotational direction as the direction of flow of liquid along the flow axes 94 of the side wall outlets 93. This would increase the speed of rotation of the second rotatable part of the nozzle head.

The electronic control processor 40 may send signals to cause a door to the shower area (e.g. a door of a shower cubicle) to lock to prevent entry into the shower area when cleaning is in operation. A motion sensor or other form of detector may be connected to the electronic control processor 40 to detect the door to the shower area being opened. When this occurs, the processor 40 will immediately stop the cleaning operation of the shower area cleaning apparatus and the apparatus cannot clean the shower area until the door is closed.

The shower area cleaning apparatus may have a container or reservoir that contains an organic compound based solution, the organic compound being miscible with water and evaporates at, say, room temperature and atmospheric pressure. Preferably, the organic compound has a molecular weight of between 30 and 150 g/mol, for example a $C_1$-$C_6$ chain alcohol, aldehyde or ketone (optionally branched) such as methanol, ethanol, propanol or acetone. This solution may be similar to the solution used for cleaning vehicle windscreens. The solution is sprayed onto surfaces of the shower area by the nozzle head, say, 3 to 5 minutes after the surfaces have been rinsed with water thus draining any residual water remaining on the surface. The organic compound subsequently evaporates and preferably effects co-evaporation of any undrained water. This removes water droplets on the surfaces, such as glass, and provides a clean, sparkling appearance. The container may be in addition to the three containers 27, 28, 29 of the apparatus or one of the three containers may contain the solution.

With reference to the modified shower cleaning apparatus 100, 200 any other suitable system may be used to wind or unwind the flexible conduit around the vertical axis.

The invention claimed is:

1. An apparatus for being mounted above an associated shower area to be cleaned, the apparatus comprising: a nozzle head for spraying cleaning fluid; a flexible conduit through which the nozzle head is arranged to receive the cleaning fluid, the flexible conduit being connected to the nozzle head; a winding mechanism including an annular channel forming a coil holder for holding a coil of the flexible conduit in a wound configuration about a vertical axis, a motor for winding and unwinding the coil of the flexible conduit about the vertical axis, a rotatable coil engagement portion including an annular wall having an inside surface that includes a rack that is engaged by a gear driven by the motor, a guide part that receives a portion of the flexible conduit therein from the annular channel, the guide part including a first portion that extends radially from the annular channel in a horizontal direction perpendicular to the vertical axis thereby minimizing a height of the winding mechanism above the associated shower area and parallel to the vertical axis and a second portion bent downwardly from the first portion whereby the flexible conduit extends therethrough, the rotatable coil engagement portion being rotatable relative to the coil holder in one direction about the vertical axis by the motor of the winding mechanism to unwind the coil from the coil holder, and being rotatable relative to the coil holder in the opposite direction about the vertical axis by the motor of the winding mechanism to wind the coil into the coil holder; and a housing for housing the nozzle head when the nozzle head is in a raised position, the bottom of the second portion of the guide part engaging the housing, the nozzle head having a first part fixed to the flexible conduit and a second, rotatable part arranged to rotate relative to the first part, wherein when the apparatus is installed and the coil is unwound, the nozzle head is lowered from the housing, and the flexible conduit leaving the housing in a position which does not laterally shift relative to other parts of the apparatus whereby the flexible conduit extends vertically downwards from the guide part, and when the coil is then wound, the nozzle head is raised up to the housing.

2. The apparatus as claimed in claim 1, wherein the rotatable coil engagement portion comprises a conduit guide for guiding the flexible conduit from the coil holder.

3. The apparatus as claimed in claim 1, wherein the rotatable coil engagement portion comprises a coil support for the coil to rest on.

4. The apparatus as claimed in claim 1, wherein the second, rotatable part of the nozzle head is arranged to rotate relative to the first part of the nozzle head about the vertical axis when the apparatus is installed.

5. The apparatus as claimed in claim 1, wherein the second, rotatable part of the nozzle head has at least one first outlet positioned to cause the second, rotatable part to rotate relative to the first part when pressurized cleaning fluid supplied to the nozzle head leaves the first outlet.

6. The apparatus as claimed in claim 5, wherein the first outlet has a flow axis offset from a rotation axis of the second, rotatable part.

7. The apparatus as claimed in claim 6, wherein the second, rotatable part of the nozzle head has a plurality of circumferentially spaced first outlets each with a flow axis disposed at an obtuse angle with respect to a radial direction.

8. The apparatus as claimed in claim 1, wherein the second, rotatable part of the nozzle head has at least one second outlet in a face distal to the first part of the nozzle head.

9. The apparatus as claimed in claim 1, wherein the second, rotatable part of the nozzle head has a magnetic bearing in relation to the first part of the nozzle head.

10. The apparatus as claimed in claim 1, wherein the rack is located adjacent and closer to a radially outer portion of the housing than a central axis of the housing.

* * * * *